US008590220B2

(12) United States Patent
Ozaki et al.

(10) Patent No.: US 8,590,220 B2
(45) Date of Patent: Nov. 26, 2013

(54) METAL JOINT, DAMPING STRUCTURE, AND ARCHITECTURAL CONSTRUCTION

(75) Inventors: Fuminobu Ozaki, Tokyo (JP); Yoshimichi Kawai, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/138,579

(22) PCT Filed: Mar. 11, 2010

(86) PCT No.: PCT/JP2010/001759

§ 371 (c)(1),
(2), (4) Date: Sep. 7, 2011

(87) PCT Pub. No.: WO2010/103842

PCT Pub. Date: Sep. 16, 2010

(65) Prior Publication Data

US 2012/0017523 A1 Jan. 26, 2012

(30) Foreign Application Priority Data

Mar. 12, 2009 (JP) ..... 2009-059393

(51) Int. Cl.
*E04B 1/98* (2006.01)
*E04H 9/02* (2006.01)

(52) U.S. Cl.
USPC ..... 52/167.3; 52/167.1

(58) Field of Classification Search
USPC ..... 52/167.3, 167.1, 167.4, 167.7, 167.8, 52/223.8, 223.12
See application file for complete search history.

(56) References Cited

U.S. PATENT DOCUMENTS

| | | | | |
|---|---|---|---|---|
| 7,987,639 | B2 * | 8/2011 | Christopoulos et al. | 52/167.3 |
| 2004/0035065 | A1 * | 2/2004 | Orszulak et al. | 52/167.1 |
| 2008/0307722 | A1 * | 12/2008 | Christopoulos et al. | 52/167.1 |
| 2010/0251637 | A1 * | 10/2010 | Nishimoto et al. | 52/167.8 |

FOREIGN PATENT DOCUMENTS

| | | |
|---|---|---|
| CN | 1255952 | 6/2000 |
| CN | 1401871 | 3/2003 |
| JP | 01-202431 | 8/1989 |
| JP | 2000-27482 | 1/2000 |
| JP | 2002-235457 | 8/2002 |
| JP | 2004-092096 | 3/2004 |

(Continued)

OTHER PUBLICATIONS

International Search Report dated Jun. 15, 2010 issued in corresponding PCT Application No. PCT/JP2010/001759.

(Continued)

*Primary Examiner* — Mark Wendell
(74) *Attorney, Agent, or Firm* — Kenyon & Kenyon LLP

(57) ABSTRACT

The invention provides a metal joint connecting a pair of subject members relatively displaceable in one direction, a metal joint connecting a pair of subject members relatively displaceable in one direction, the metal joint comprising: multiple first attachment portions attached to one of the subject members; a second attachment portion attached to an other of the subject members; and multiple plate portions connecting between the first attachment portions and the second attachment portion to each other, wherein an attachment direction of each of the first attachment portions with respect to one subject member and an attachment direction of the second attachment portion with respect to the other subject member are set so that a surfaces of the plate portions follow a direction of the relative displacement.

9 Claims, 15 Drawing Sheets

(56) References Cited

FOREIGN PATENT DOCUMENTS

| | | |
|---|---|---|
| JP | 2006-214120 | 8/2006 |
| JP | 2008-38983 | 2/2008 |
| JP | 2008-111331 | 5/2008 |
| JP | 2008-111332 | 5/2008 |
| WO | WO 2009/093712 | 7/2009 |

OTHER PUBLICATIONS

Chinese Office Action dated May 23, 2013, issued in corresponding Chinese Application No. 201080011020.9, with an English translation of the Search Report only.

* cited by examiner

METAL JOINT, DAMPING STRUCTURE, AND ARCHITECTURAL CONSTRUCTION

BACKGROUND OF THE INVENTION

1. Field of the Invention

The present invention relates to a metal joint connected between a pair of subject members and exhibiting energy absorbing performance with relative displacement between the subject members, a damping structure using the metal joint, and an architectural construction adopting the damping structure. This application is a national stage application of International Application No. PCT/JP2010/001759, filed Mar. 11, 2010, which claims priority to Japanese Patent Application No. 2009-059393, filed Mar. 12, 2009, the content of which is incorporated herein by reference.

2. Description of Related Art

In recent years, an architectural construction such as a house or an apartment building adopting a damping structure suppressing vibration generated by earthquakes using a vibration damper has been increasingly utilized due to increased attention to disaster prevention. As a vibration damper of this type of damping structure, for example, a steel damper using hysteretic energy absorption with yielding of steel has been widely used in many architectural constructions since the damper exhibits excellent damping properties at a low cost. In the steel damper, a brace damper resisting an axial force is widely used since the mechanism thereof is simple and is easily designed.

For example, the technique disclosed in Patent Document 1 proposes a damping structure in which a base plate damper is interposed between a base and a leg of a pillar. Flexural yielding or shear yielding occurs in the base plate when a tensile force is applied to the pillar, and the tensile force generated at the leg is absorbed by the hysteretic energy absorption, such that damping properties may be exhibited.

Further, Patent Document 2 discloses a technique in which a steel sheet for a damper causing flexural-shear yielding is adopted, so that an increase in shear bearing force is suppressed even when a load is repeatedly applied to the steel sheet for the damper subjected to shear yielding.

In all techniques of Patent Document 1 and Patent Document 2 using a single thin body as a vibration damper, the energy absorbing properties are exhibited using the above-described shear yielding through a single thin plate. However, such a single thin plate has a problem in that in-plane rigidity and out-of-plane rigidity are not sufficient or the energy absorbing amount is reduced due to the occurrence of buckling.

When the plate thickness of the steel sheet used as a vibration damper is increased to improve the in-plane and out-of-plane rigidity and improve the buckling resistance, there is a problem in that the constructability at the time of connection assembly is degraded or the material cost increases with an increase in weight. Further, there is a need to increase the dimensions of the damper portion in order to ensure the vibration energy absorbing amount, but there is a problem in that basically says that increase in size prevents a decrease in size and high energy absorbing properties.

In addition, when the plate thickness of the single plate is increased, there is a need to increase the thickness and the size of the attachment portion so as to prevent the yielding of the attachment portion receiving a reaction force of a bending stress or a shear stress at the end of the damper. Furthermore, when the damper with a large plate thickness is used, there are problems in that the degree of fixation at the end of the damper with respect to the flexural deformation or shear deformation becomes relatively smaller and the rigidity of the damper is degraded.

Further, a vibration damper absorbing vibration energy by contracting a folded plate has been proposed. In the vibration damper, for example, a damping device is proposed which is bent toward the inside or the outside of a groove surface of a framework as shown in Patent Document 3 and absorbs displacement by being deformed toward the inside or the outside of the groove surface of the framework.

However, in the technique disclosed in Patent Document 3, the vibration damper is attached to the inside of the connection portion between a pillar and a beam intersecting each other. For this reason, the energy to be absorbed by the vibration damper having a folded plate shape proposed in the technique is not large, and therefore, the rigidity thereof may be low. Further, since the vibration damper is attached to a connection portion having a narrow gap, a folded plate is formed in which two or three hill and valley portions are alternately and continuously formed.

Furthermore, since the deformation absorption occurs by the contraction of the folded plate, the technique is a barrier to improving the vibration energy absorbing amount. Further, the rigidity of the vibration damper comes small.

Patent Document 4 discloses a technique in which a gap between plate members formed of Zn—Al alloy facing and separating from each other is partitioned into multiple spaces by a wavy partitioning plate formed of Zn—Al alloy to form a honeycomb structure.

However, in the technique disclosed in Patent Document 4, since the energy is not absorbed by the plastic deformation of the partitioning plate, it is not possible to absorb the large energy caused by a heavy earthquake.

Furthermore, the vibration to be absorbed by the disclosed technique is, for example, a comparatively small vibration generated in daily life such as the footsteps of a resident. Such the vibration generated in daily life may be suppressed by the elastic deformation and the damping effect of the partitioning plate; however, a large vibration such as an earthquake vibration may not be suppressed in such a configuration. That is, in Patent Document 4, it is not supposed that the earthquake vibration energy can be absorbed.

CITATION LIST

Patent Document

[Patent Document 1] Japanese Unexamined Patent Application, First Publication No. 2004-92096

[Patent Document 2] Japanese Unexamined Patent Application, First Publication No. 2008-111332

[Patent Document 3] Japanese Unexamined Patent Application, First Publication No. 2002-235457

[Patent Document 4] Japanese Unexamined Patent Application, First Publication No. H01-202431

SUMMARY OF THE INVENTION

The invention is made in view of the above-described problems. It is an object of the invention to provide a metal joint connected between a pair of subject members and exhibiting an energy absorbing properties of absorbing energy with relative displacement between the subject members. In particular, to a metal joint and a vibration damper capable of improving vibration energy absorbing performance with regard to the vibration energy of an earthquake or the like and improving the rigidity thereof and an architectural construction using the same.

In order to solve the above-described problem, the invention has contrived a metal joint which is bonded between a pair of upper and lower subject members and exhibits an energy absorbing properties of absorbing energy with relative displacement in the horizontal direction between the subject members. In the metal joint, the hill and valley portions are alternately formed in a first direction, and a web member is formed between the hill and valley portions. Then, the hill portion is bonded to one subject member, and the valley portion is bonded to the other subject member. Then, an energy absorbing properties is exhibited in a manner such that plastic deformation occurs in the web member with the relative displacement between the subject members in a second direction.

At this time, when a slit is formed in the web member of the metal joint in the plate thickness direction so that the yield stress of the web member is low, the above-described plastic deformation may be more effectively performed. As a result, it is possible to effectively provide desired energy absorbing properties.

Further, in the invention, it is one object to reduce the yield stress, but the shape of the slit may be optimized so that flexural yielding or shear yielding are simultaneously performed. In this case, it is possible to increase the energy absorbing amount by further increasing the plastic deformation amount with the slit forming. As a result, it is possible to prevent damage to the periphery (the hill portion and the valley portion) of the web member by suppressing an increase in bearing force after the yielding of the web member.

Further, since the slit is formed in the web member, the plastic deformation may be limited within the plane of the web member, so that unstable movement may be prevented.

Further, in order to solve the above-described problems, the inventor has contrived a damping structure that exhibits an energy absorbing properties of absorbing energy with relative displacement between brace main members as the subject members. The damping structure includes a pair of the brace main members attachable to an architectural construction and a metal joint having hill and valley portions alternately formed in the first direction and a web member formed between the hill and valley portions.

Then, the hill portion is attached to one subject member, and the valley portion is attached to the other subject member. Then, the energy absorbing properties may be exhibited in a manner such that the plastic deformation occurs in the web member with the relative displacement between the subject members in the second direction.

Although the outline of the invention has been described as above, more specifically, the inventor has contrived a metal joint, a damping structure including the metal joint, and an architectural construction adopting the damping structure illustrated in the following configuration.

(1) According to an aspect of the invention, there is provided a metal joint connecting a pair of subject members relatively displaceable in one direction, the metal joint comprising: multiple first attachment portions attached to one of the subject members; a second attachment portion attached to an other of the subject members; and multiple plate portions connecting between the first attachment portions and the second attachment portion, wherein an attachment direction of each of the first attachment portions with respect to one subject member and an attachment direction of the second attachment portion with respect to the other subject member are set so that a surfaces of the plate portions follow a direction of the relative displacement.

(2) In the metal joint according to (1), the metal joint is a folded plate that includes hill and valley portions continuously formed in an order of the first attachment portion, the plate portion, and the second attachment portion.

(3) In the metal joint according to (1), a total yield stress of the plate portions is smaller than that of any of the subject members.

(4) In the metal joint according to (1), a penetration hole is formed in each of the plate portion in a plate thickness direction thereof.

(5) In the metal joint according to (4), a plurality of the holes is formed in a direction of the relative displacement, and wherein a slim portion is formed between the holes.

(6) According to another aspect of the invention, there is provided a damping structure including: a pair of subject members forming a part of an architectural construction and relatively displaceable in one direction; and the metal joint, according to any one of claims (1) to (5), which connects between the subject members.

(7) In the damping structure according to (6), one of the subject members is H-section steel, the other of the subject members is a steel pipe or a light channel steel, each of the first attachment portions is attached to a web member of the H-section steel, and the second attachment portion is attached to the steel pipe or the light channel steel.

(8) In the damping structure according to (7), a lower end of the steel pipe or the light channel steel is fixed to a ground, and the H-section steel is a pillar.

(9) According to another aspect of the invention, there is provided an architectural construction comprising the damping structure according to (6).

(10) In the architectural construction according to (9), being a thin thickness and light weight structure.

When the pair of subject members is connected to each other by using the metal joint according to (1) and relative displacement occurs between the subject members, and plastic deformation occurs in each of the plate portion in the direction of the relative displacement. By the plastic deformation, each of the plate portion exhibits the stable energy absorbing properties while an increase in bearing force is suppressed. As a result, it is possible to exhibit the damping properties of suppressing the relative displacement between the subject members.

Furthermore, since the subject members are connected to each other through multiple plate portions, it is possible to improve the rigidity compared to the case in which one plate portion is used. In other words, both edges (that is, both edges formed between each of the plate portion and the first and second attachment portions) of each of the plate portion are restrained by the first attachment portion and the second attachment portion in the direction of the relative displacement. For this reason, when these plate portions deformation occurs in the direction of the relative displacement, the plastic deformation occurs while both edges thereof are restrained. Accordingly, even when a shear force about the axis along the surface and perpendicular to both edges is generated, each of the plate portions may receive the shear force by the above-described restraint.

As a result, since the torsional rigidity increases, it is possible to prevent the degradation of the energy absorbing properties when each of the plate portions is twisted and falls laterally. Accordingly, since plastic deformation of each of the plate portion may reliably occur in the direction of the relative displacement compared to the case where the first attachment portion and the second attachment portion are not provided, it is possible to more stably absorb energy. Due to the above-described reasons, when the metal joint is used for the connection between the subject members as a part of the architectural construction, it is possible to improve the energy absorbing properties of absorbing vibration energy of an earthquake or the like and improve the rigidity.

In the case of (2), since the metal joint is formed as a folded plate, when the subject members are connected to each other by the metal joint, one folded plate may reciprocate several times between the subject members, so that the number of plates interposed between the subject members may be increased. As a result, it is possible to obtain a structure in which multiple metal joints are disposed between the subject members. Accordingly, even in the single metal joint, the relative displacement energy generated between the subject members may be absorbed by the plurality of plate portions, so that the relative displacement energy absorbing efficiency increases compared to the existing structure and the damping properties improves.

In other words, since the metal joint is formed as a folded plate, it is possible to improve the in-plane flexural rigidity, the out-of-plane flexural rigidity, and the torsional rigidity of each of the plate portion. That is, in each of the plate portion, for example, not only flexural rigidity (in-plane flexural rigidity) in the direction depicted by the arrow R1 shown in FIG. 5, but also flexural rigidity (out-of-plane rigidity) in the direction depicted by the arrow R2 shown in the same drawing increase.

Furthermore, in each of the plate portion, not only torsional rigidity in the direction depicted by the arrow N1 shown in FIG. 5, but also torsional rigidity in the direction depicted by the arrow N2 shown in the same drawing increase. Accordingly, it is possible to suppress an unstable phenomenon such as buckling or torsional buckling of each of the plate portion.

Further, since the metal joint may be manufactured by folding one steel sheet, it is not necessary to provide a process of connecting multiple plate portions by welding or the like and the metal joint can be manufactured at a low cost.

In the case of (4), since it is possible to allow the rigidity of the portion around the hole to be weaker than that of the continuous portion between the first attachment portion, the second attachment portion, and the plate portion, the energy absorbing properties may be exhibited by causing plastic deformation to occur first in the portion around the hole. As a result, it is possible to suppress a reaction force acting on the continuous portion. Further, since plastic deformation of each of the plate portion easily occurs due to the hole, it is possible to reduce the rigidity and the bearing force necessary for the subject members receiving the reaction force when plastic deformation occurs in the plate portion.

As a result, it is possible to decrease in thickness and size of the subject member. Further, when the thin plate portions are disposed in multiple rows, it is possible to increase the fixation degree (the degree of the rigidity and the bearing force of the subject member with respect to the rigidity and the bearing force of one plate portion) for each of the plate portion.

As a result, since the deformation of the subject member is suppressed and the rigidity of the entire damper including plate portions increases, it is possible to improve the energy absorbing properties of each of the plate portion.

DETAILED DESCRIPTION OF THE INVENTION

Figure 1:
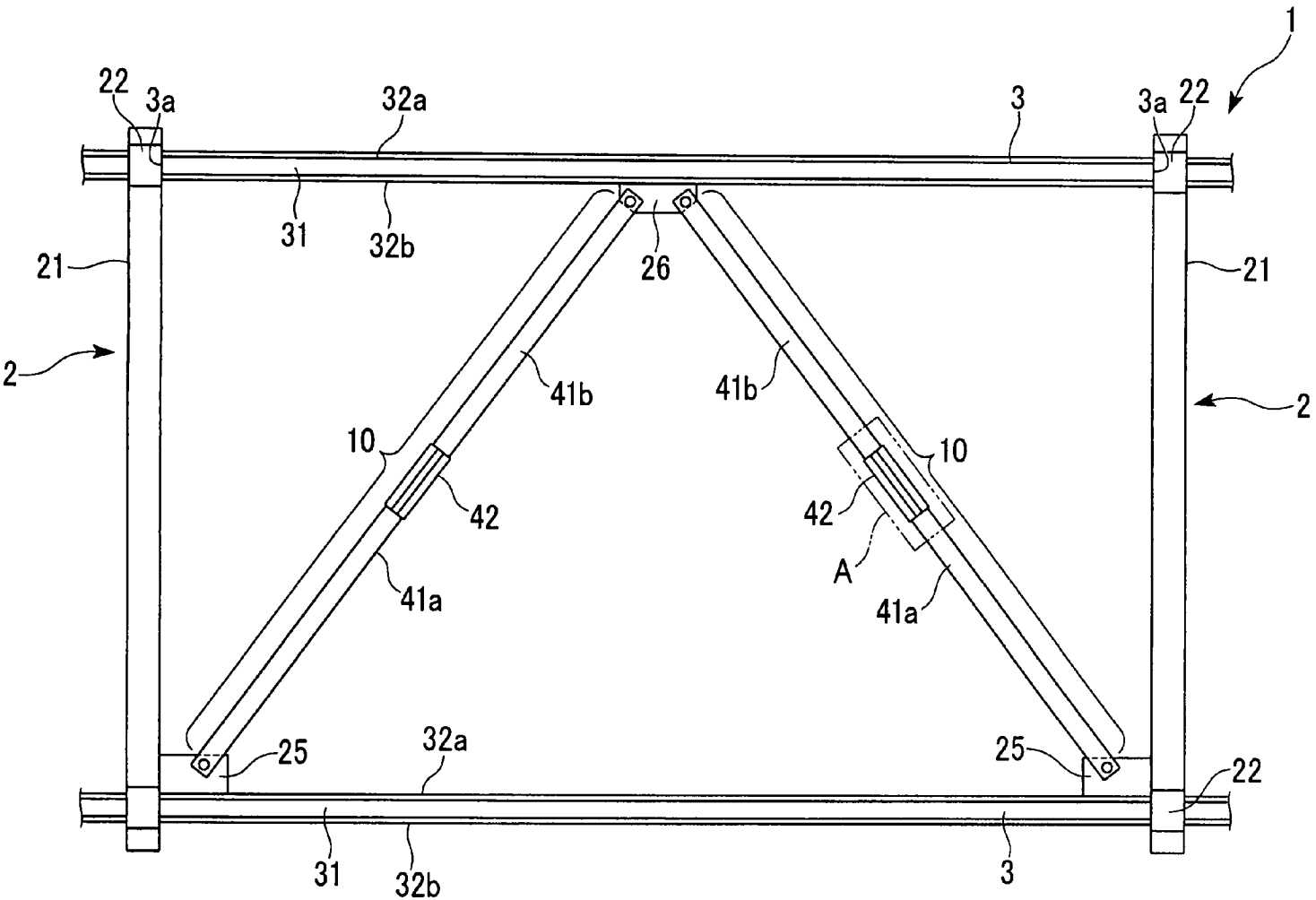
FIG. 1 is a diagram illustrating a first embodiment of the invention and is a front view illustrating an example of a framework of an architectural construction adopting a damping structure with a metal joint.

Respective embodiments of a metal joint of the invention connected between a pair of subject members and exhibiting an energy absorbing properties of absorbing energy with relative displacement between the subject members, a damping structure using the metal joint, and an architectural construction adopting the damping structure will be described below by referring to the drawings.

First Embodiment

FIG. 1 is a front view illustrating a framework of an architectural construction 1 provided with a vibration damper 10 which is a first embodiment of the damping structure of the invention. The architectural construction 1 includes multiple steel pipe pillars 2 and multiple beams 3 connected between the steel pipe pillars 2.

Each steel pipe pillar 2 has a square frame-shaped cross-section when seen from the cross-section perpendicular to the longitudinal direction, and includes a steel pipe 21 that has a predetermined plate thickness and a pillar beam connecting portion 22 that has a plate thickness thicker than that of the steel pipe 21. Each pillar beam connecting portion 22 is connected to the upper and lower ends of the steel pipe 21 in the perpendicular direction by welding while coming into contact with the upper and lower ends. The outer peripheral shape or the outer peripheral curvature for each corner of the steel pipe 21 and each pillar beam connecting portion 22 is formed by hot pressing.

Each steel pipe pillar 2 serves to prevent collapsing or falling of the architectural construction 1 while supporting the weight of the architectural construction even when the architectural construction is greatly shaken due to a heavy earthquake.

In terms of preventing the steel pipe pillar 2 from yielding first when a reaction force is generated by a heavy earthquake or the like, a vibration damper (a damping structure) 10 to be described later is provided so as to particularly suppress the deformation amount of the steel pipe pillar 2 such that the deformation is as small as possible.

Each beam 3 is what is known as H-section steel that includes a web member 31 extending in the horizontal direction and a pair of flanges 32*a* and 32*b* provided at the upper and lower edges of the web member 31. The beam 3 is formed by, for example, rolling. Furthermore, the beam 3 is not limited to the H-section steel, but may be other shapes.

Each end surface 3*a* of each beam 3 is welded to the corresponding outer surface of the steel pipe pillar 2, that is, the outer surface of the pillar beam connecting portion 22 while coming into contact therewith, so that the beam is integrated with the pillar beam connecting portion 22. As a result, the beam 3 is strongly bonded to the pillar beam connecting portion 22, to form a steel frame structure.

The steel pipe 21 of the steel pipe pillar 2 is stacked on the pillar beam connecting portion 22, and they are fixed to each other by welding. In this manner, the steel pipe pillars 2 are disposed from the lowest floor to the highest floor by alternately stacking and connecting the steel pipe 21 and the pillar beam connecting portion 22 in the vertical direction, so that the architectural construction 1 is constructed. Then, the lower end of each steel pipe pillar 2 is fixed to the ground at the lowest floor of the architectural construction 1.

In addition, FIG. 1 illustrates part of the rahmen structure in which each steel pipe pillar 2 and each beam 3 are connected to each other crossing at right angles.

Connection members 25 are provided at the intersecting portions between the beam 3 and both steel pipe pillars 2 so as to be directed upward. Further, a connection member 26 is provided at the center of the lower area of other beam 3 so as to be directed downward. The connection members 25 and 26 are strongly fixed by welding, bolting, or the like.

In the vibration damper 10 of the embodiment, one end thereof is swingably attached to the connection member 25, and the other end thereof is swingably attached to the connection member 26. The vibration damper 10 includes two brace main members 41*a* and 41*b* including the subject member and a damping portion 42. One end of the damping portion 42 is attached to the brace main member 41*a*, and the other end thereof is attached to the brace main member 41*b*.

In other words, the brace main member 41*a* attached to one connection member 25 is attached to the brace main member 41*b* attached to the other connection member 26 through the damping portion 42. Then, the brace main members 41*a* and 41*b* and the damping portion 42 are coaxially arranged in the extension direction.

Figure 2A:
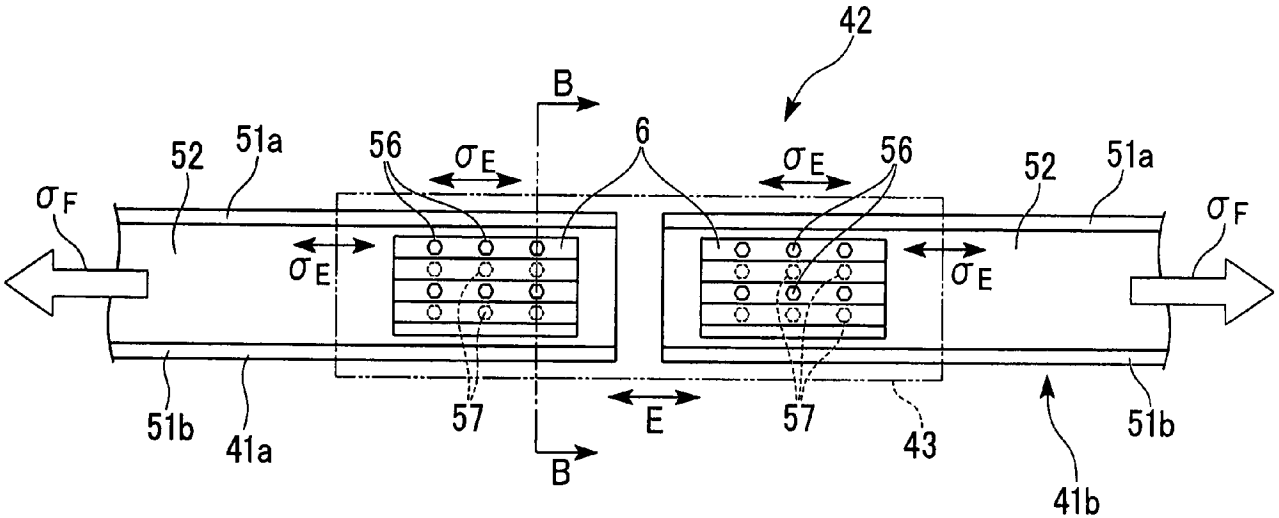
FIG. 2A is a diagram illustrating the damping structure and is an enlarged view of the part A of FIG. 1.
Figure 2B:
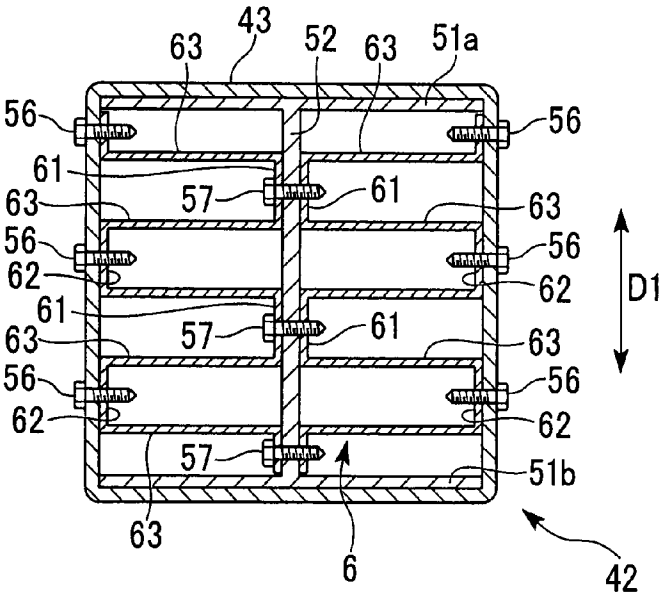
FIG. 2B is a diagram illustrating the damping structure and is a cross-sectional view taken along the line B-B of FIG. 2A.

FIG. 2A is an enlarged view illustrating the part A of FIG. 1 and specifically illustrating the structure around the damping portion 42. Further, FIG. 2B is a cross-sectional view taken along the line B-B of FIG. 2A. In the damping portion 42, one end of the brace main member 41*a* is connected to one end of the brace main member 41*b* through one steel pipe 43 having a rectangular cross-section and four metal joints 6 while the ends butt each other.

Figure 3:
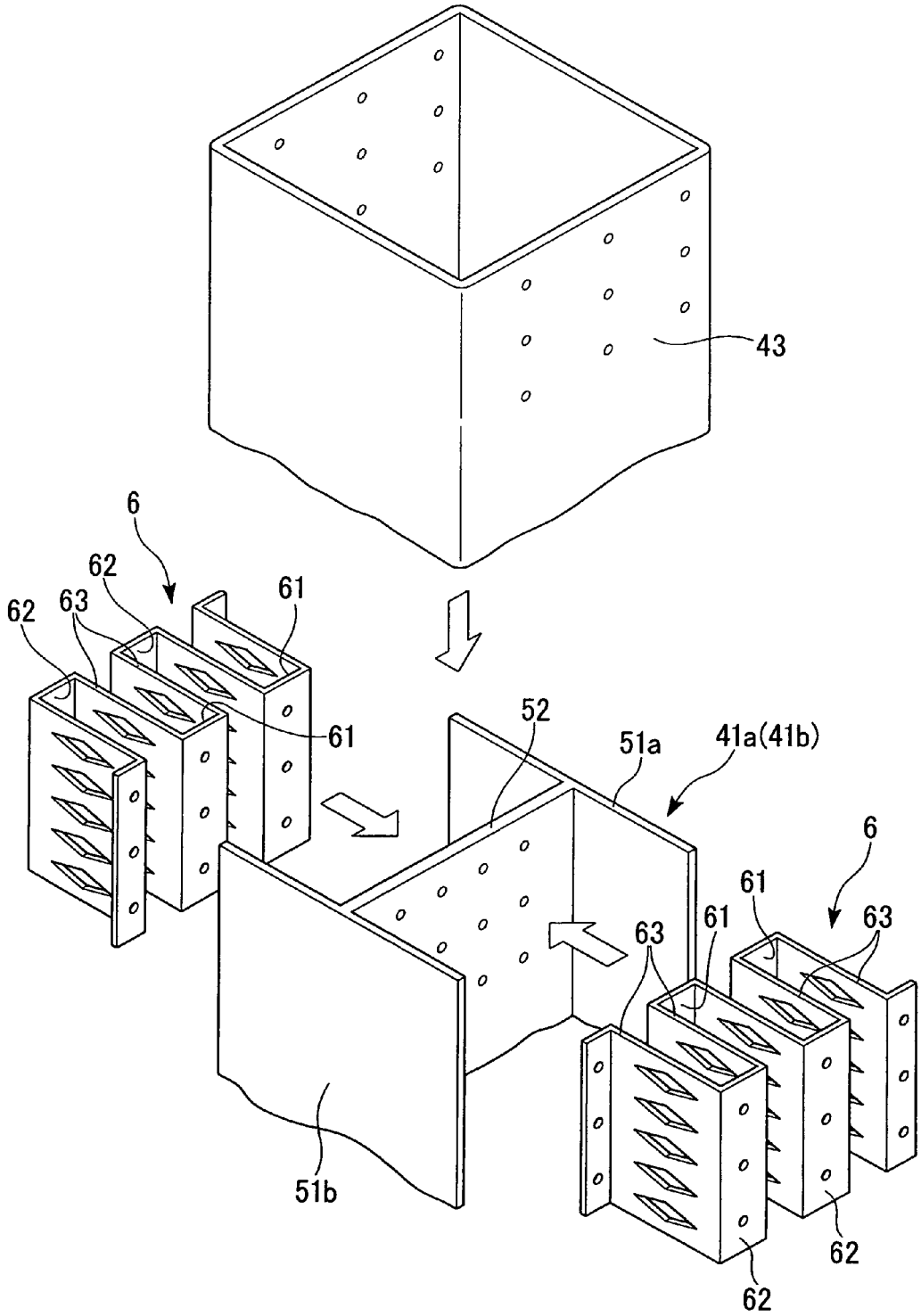
FIG. 3 is an exploded perspective view illustrating the damping structure.
Figure 4:
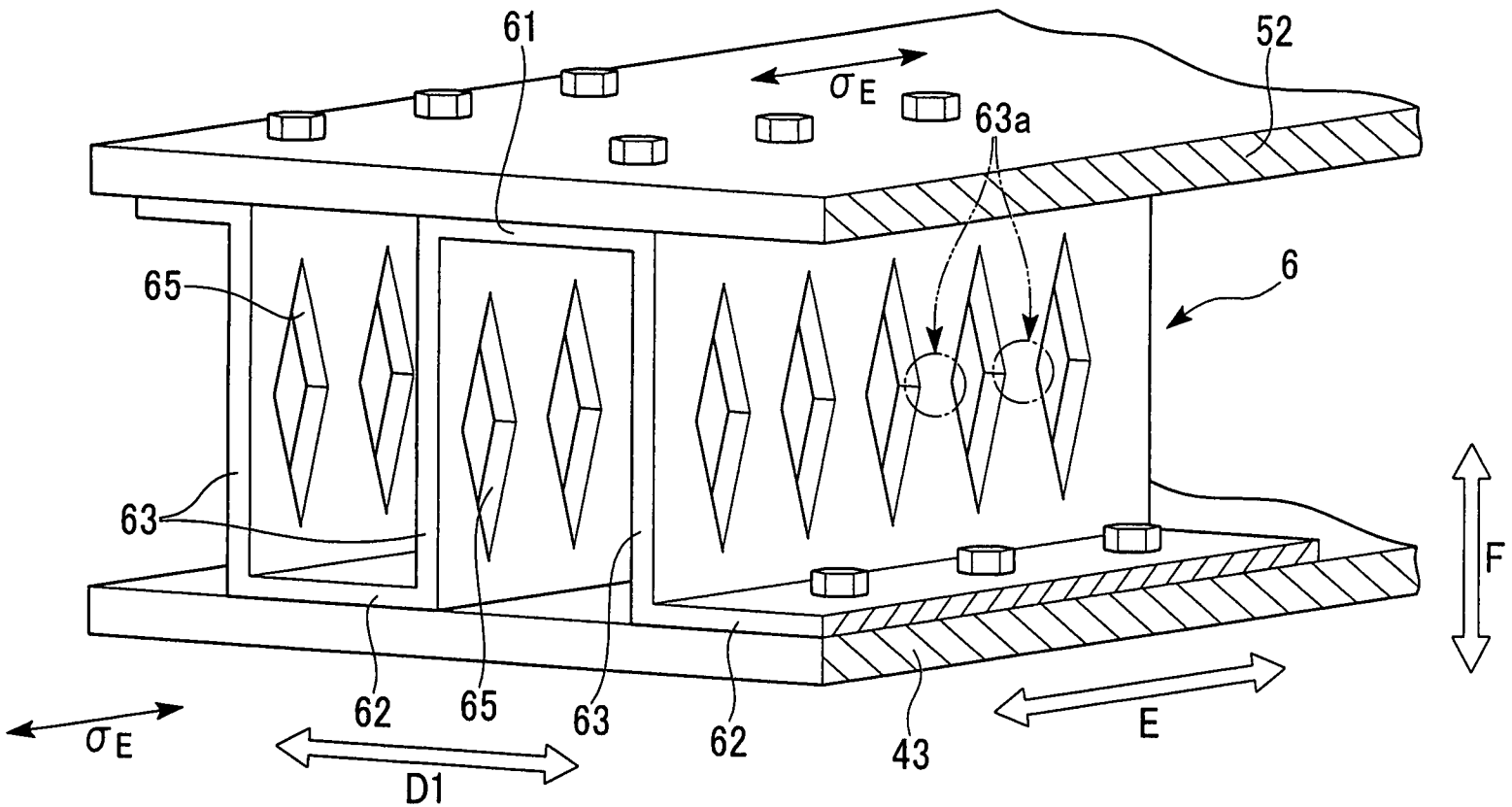
FIG. 4 is a perspective view illustrating a part of the metal joint of the invention.

FIG. 3 is an exploded perspective view illustrating the assembly of the damping portion 42, and FIG. 4 is a perspective view illustrating a part of the metal joint 6.

As shown in FIGS. 2A to 3, each of the brace main members 41*a* and 41*b* is so-called H-section steel that includes a web member 52 extending in one direction and a pair of flanges 51*a* and 51*b* integrally formed with the upper and lower edges of the web member 52.

Each metal joint 6 includes multiple (in the example shown in the drawings, two) hill portions 61 and multiple (in the example shown in the drawings, two) valley portions 62 which are alternately formed in the longitudinal direction D1 of one rectangular steel sheet. More specifically, the hill portions 61 and the valley portions 62 are formed by alternately and perpendicularly bending the steel sheet in the longitudinal direction D1 by bending. Further, a web member (a plate portion) 63 is continuously formed between the hill portion 61 and the valley portion 62. Each hill portion 61 of the metal joint 6 is attached to the web member 52 by multiple bolt screws 57, and each valley portion 62 is attached to the steel pipe 43 by multiple bolt screws 56.

In this manner, each hill portion 61 and each valley portion 62 of the metal joint 6 are attached to the subject member. Furthermore, the subject member mentioned in the invention indicates an attachment subject of the metal joint 6. For example, the damping portion 42 of the embodiment, the web member 52 with the attached hill portion 61 and the steel pipe 43 with the attached valley portion 62 correspond to the subject members.

As shown in FIG. 4, each web member 63 of the metal joint 6 is provided with a slit (hole) 65 provided at one or more positions (in the example shown in the drawings, five positions). The slits 65 are disposed on the web member 63 at the same interval in the direction perpendicular to at least the longitudinal direction D1 (that is, the slits are disposed at the same interval in the axial direction E of the brace main members 41*a* and 41*b*). Furthermore, the arrangement of the slits 65 is not limited to one row shown in the drawings, but may be multiple rows. Further, the invention is not limited to the case where the slits 65 are evenly arranged, but the slits may be randomly disposed.

Each slit 65 may have any shape, but it is desirable that the slit be perpendicular to the axial direction of at least the subject member and be elongated in the direction F as the direction substantially perpendicular to the surface of the subject member (the web member 52 and the steel pipe 43). Further, in the example of FIG. 4, a case is shown in which a diamond-shaped slit 65 is adopted, but the invention is not limited thereto. A rectangular shape may be adopted, and a polygonal shape or an indefinite shape may be adopted.

Since the slits 65 are formed in each web member 63, the yield strength of the web member 63 may be reduced. Specifically, when a stress $\sigma_E$ is applied in the axial direction E between the subject members (the web member 52 and the steel pipe 43), so that relative displacement occurs in the axial direction E between the subject members (the web member 52 and the steel pipe 43), flexural yielding of each web member 63 may be easily caused in the axial direction E.

Figure 6:
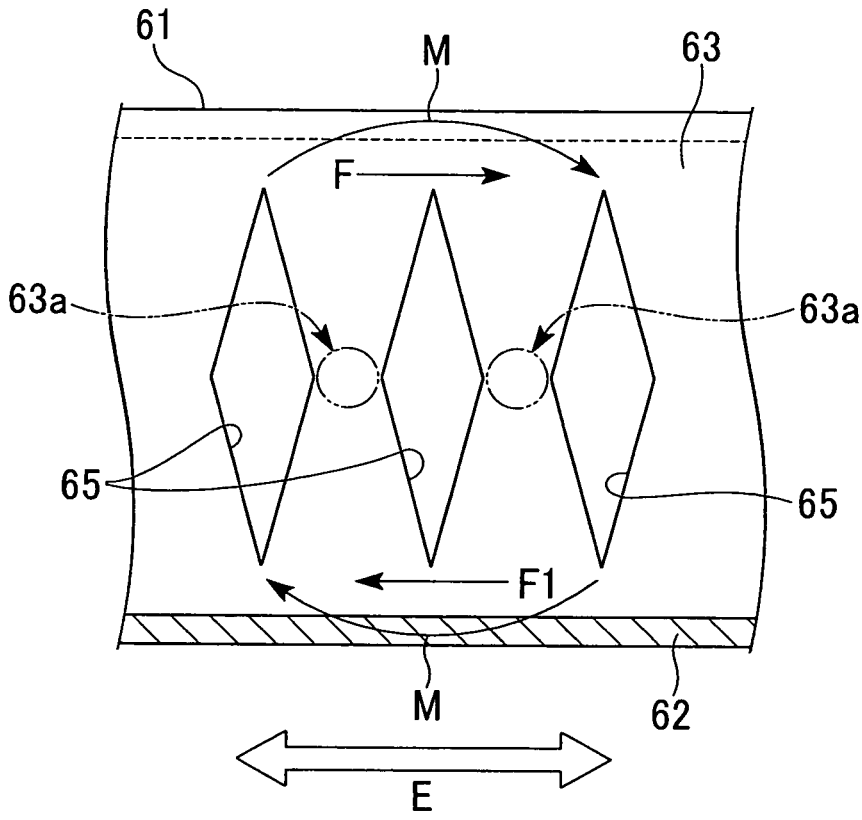
FIG. 6 is a partially enlarged view illustrating an operation of the metal joint of the invention.

As shown in FIG. 6, as for flexural yielding, the region 63*a* may yield first since the slim portion is provided at the region 63*a* between the adjacent slits 65 so as to have the minimal width in the axial direction E.

Figure 5:
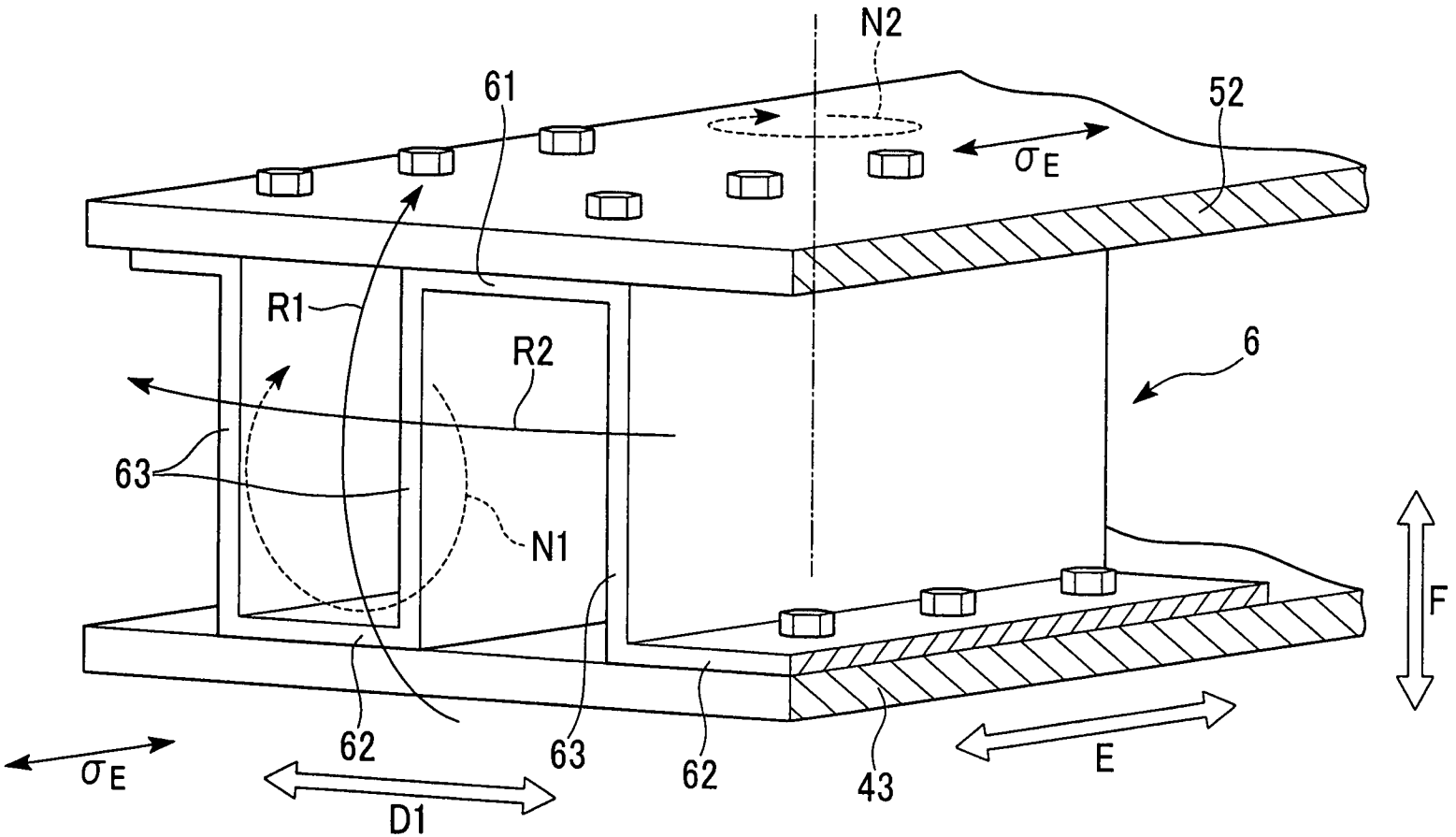
FIG. 5 is a diagram illustrating a modified example of the metal joint and is a diagram corresponding to FIG. 4.

Furthermore, each slit 65 may not be essential to provided at each web member 63. For example, as shown in FIG. 5, a configuration may be adopted in which the slit 65 is not formed in the web member 63. However, even when the slit 65 is not provided, the material or the shape of the web member 63 needs to be optimized so that the total yield stress of each web member 63 is smaller than the yield stress of each subject member (the web member 52 and the steel pipe 43) to have the same effect in which each slit 65 is provided.

The metal joint 6 with the above-described configuration is provided between the brace main member 41*a* and the steel pipe 43 and between the brace main member 41*b* and the steel pipe 43. Therefore, as a stress transmitting path, the stress is transmitted in an (or reversed) order of the brace main member 41*a*, the metal joint 6, the steel pipe 43, another metal joint 6, and the brace main member 41*b*.

Next, the operation of the vibration damper 10 with the above-described configuration will be described. When the architectural construction 1 is shaken due to a seismic force generated by an earthquake or the like, as shown in FIG. 2A, a stress $\sigma_F$ is applied to each of the brace main members 41*a* and 41*b* of the vibration damper 10. As a result, a stress $\sigma_E$ is applied in the axial direction E particularly between the subject members (the web member 52 and the steel pipe 43). Then, as shown in FIG. 4, when relative displacement occurs in the axial direction E between the subject members (the web member 52 and the steel pipe 43), as shown in FIG. 6, a shear force F1 acts on each web member 63, so that bending moment M is applied thereto.

Then, flexural yielding of each web member 63 is caused in the region 63*a* between the adjacent slits 65 in accordance with the bending moment M. As a result, the specific effect to be described later may be exhibited.

That is, since the metal joint 6 performs the above-described operation, flexural yielding of each web member 63 may be performed earlier than the other portions. As a result, plastic deformation occurs in each web member 63, so that a stable deformation energy absorbing properties may be exhibited while a bearing force thereof is suppressed.

Then, since the metal joint 6 exhibits the energy absorbing properties of absorbing energy with the relative displacement between the subject members, in the entire vibration damper 10, the energy absorbing properties may be exhibited from two positions, that is, a position between the brace main member 41*a* and the steel pipe 43 and a position between the steel pipe 43 and the brace main member 41*b*. That is, the damping properties of the vibration damper 10 may be exhibited in the architectural construction 1.

Furthermore, the metal joint 6 of the embodiment has a folded plate structure and has a shape in which multiple web members 63 reciprocate several times between the subject members (the web member 52 and the steel pipe 43). For this reason, the arrangement density of the web members 63 between the subject members (the web member 52 and the steel pipe 43) may improve, so that the web members 63 are disposed between the subject members (the web member 52 and the steel pipe 43).

As a result, since the web members 63 having the energy absorbing properties may be disposed instead of a single web member, it is possible to improve the energy absorbing efficiency with an increasing number of web members and further improve the damping properties.

Furthermore, since the gap between the subject members (the web member 52 and the steel pipe 43) is generally narrow, the method of disposing an energy absorbing unit in the narrow gap has been considered as a big problem in the past.

In order to solve this problem, in the embodiment, since the metal joint 6 of the folded structure is disposed at the gap and the yield strength of each web member 63 is low, the plurality of web members 63 may be disposed at the gap. As a result, the damping portion 42 and the vibration damper 10 may be compactly formed.

Further, since the metal joint 6 of the embodiment adopts the folded structure and increases the arrangement density of the web members 63 between the subject members (the web member 52 and the steel pipe 43), the rigidity may improve and buckling prevention properties may improve. That is, the metal joint 6 of the embodiment may improve both the energy absorbing properties and the rigidity. In particular, since there is no need to increase the plate thickness of the damper member like the related art in order to improve the rigidity and the buckling prevention properties, the damping structure may be compactly formed, so that the configuration of the invention is effective. Further, the material cost may be reduced or the vibration damper 10 may be more easily attached.

Furthermore, the metal joint 6 of the embodiment is formed by folding that folds one steel sheet. For this reason, it is not necessary to perform welding, screw-connecting, bolt-connection, or the like between steel sheets when manufacturing the metal joint 6, and further the vibration damper 10 may be more easily manufactured.

Furthermore, in the embodiment, the metal joint 6 has been exemplified in which the steel sheet is alternately folded to reciprocate in the direction perpendicular to the longitudinal direction to form the hill portion 61 and the valley portion 62. Then, a case has been described in which the bending angle is formed by bending the steel sheet in the direction substantially perpendicular to the longitudinal direction of the steel sheet.

However, the invention is not limited to this configuration. For example, the bending angle when forming each hill portion 61 and each valley portion 62 is not limited to 90°, but the bending may be performed with other angles.

Figure 7:
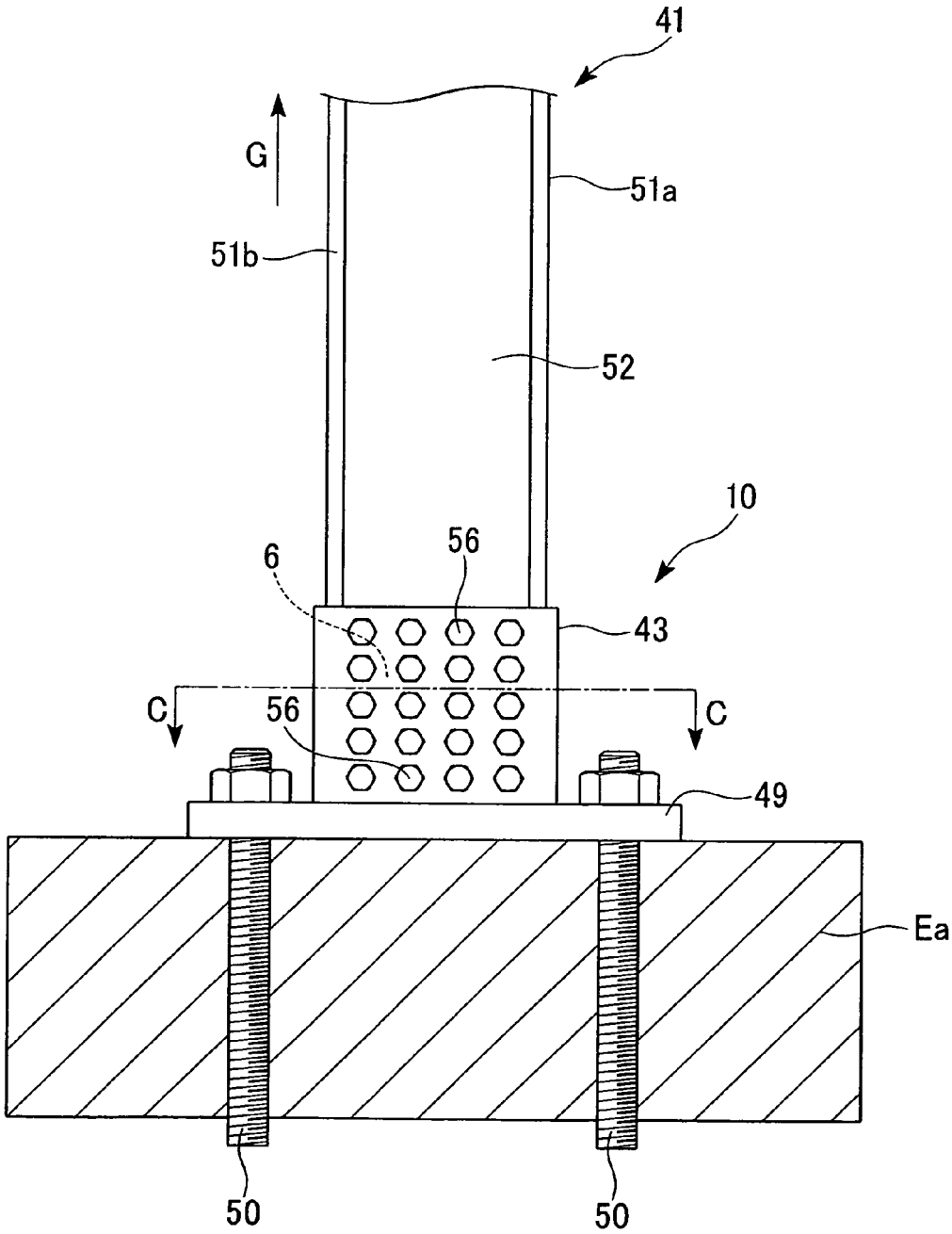
FIG. 7 is a front view illustrating an example in which the damping structure of the invention is applied to a base of a pillar of the architectural construction.

FIG. 7 illustrates an application example in which the brace main member 41 formed of H-section steel forming the vibration damper 10 is used as a pillar and the lower end thereof is fixed to the ground.

The lower end of the brace main member 41 is attached to the steel pipe 43 through the metal joint 6 bonded to the web member 52. Then, the steel pipe 43 is fixed to the base plate 49. The base plate 49 is fixed to the ground Ea by multiple bolts 50.

Since the configuration of the vibration damper 10 in the cross-section C-C of FIG. 7 is the same as the above-described configuration of FIG. 2B, the same reference numerals are given to the same components and members, and the detailed description thereof is omitted.

Then, when a tensile stress is applied to the brace main member 41 in the direction G of FIG. 7, relative displacement occurs between the subject members (the web member 52 and the steel pipe 43), but plastic deformation occurs in the metal joint 6 with the relative displacement, so that the energy absorbing properties may be exhibited. As a result, it is possible to reduce a vibration of the brace main member 41 as the pillar and improve the rigidity as described above.

Figure 8:
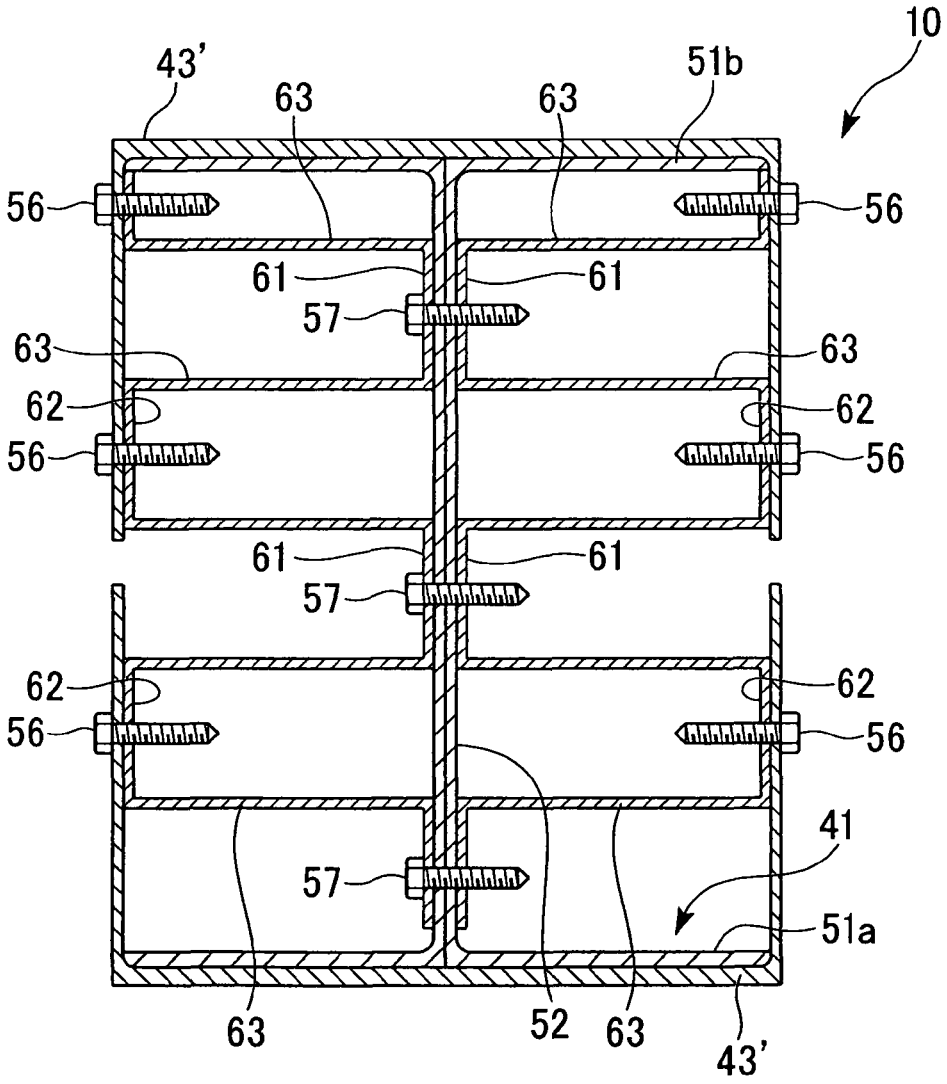
FIG. 8 is a diagram illustrating a modified example of the shape of FIG. 7 and is a cross-sectional view taken along the line C-C of FIG. 7.

FIG. 8 illustrates an example in which the brace main member 41 formed of H-section steel forming the vibration damper 10 is used as a pillar and a channel steel 43' is connected instead of the steel pipe 43 shown in FIG. 7. In the following description, the same reference numerals are given to the same components and members as those of FIG. 2B, and repetitive descriptions thereof are omitted.

As shown in FIG. 8, in the configuration example, two channel steel members 43' are disposed so that the U-shaped opening portions face each other. Then, each valley portion 62 of the metal joint 6 is bonded to the U-shaped inner surface portion of the channel steel 43' by multiple bolt screws 56 while the flange 51*a* or 51*b* of the brace main member 41 comes into contact with the U-shaped bottom surface portion of the channel steel 43'.

Even in this configuration, when relative displacement occurs between the subject members (the web member 52 and each channel steel 43'), plastic deformation occurs in each web member 63 of the metal joint 6, so that the energy absorbing properties may be exhibited. As a result, it is possible to reduce the vibration of the brace main member 41 as the pillar and improve the rigidity as described above.

Figure 9:
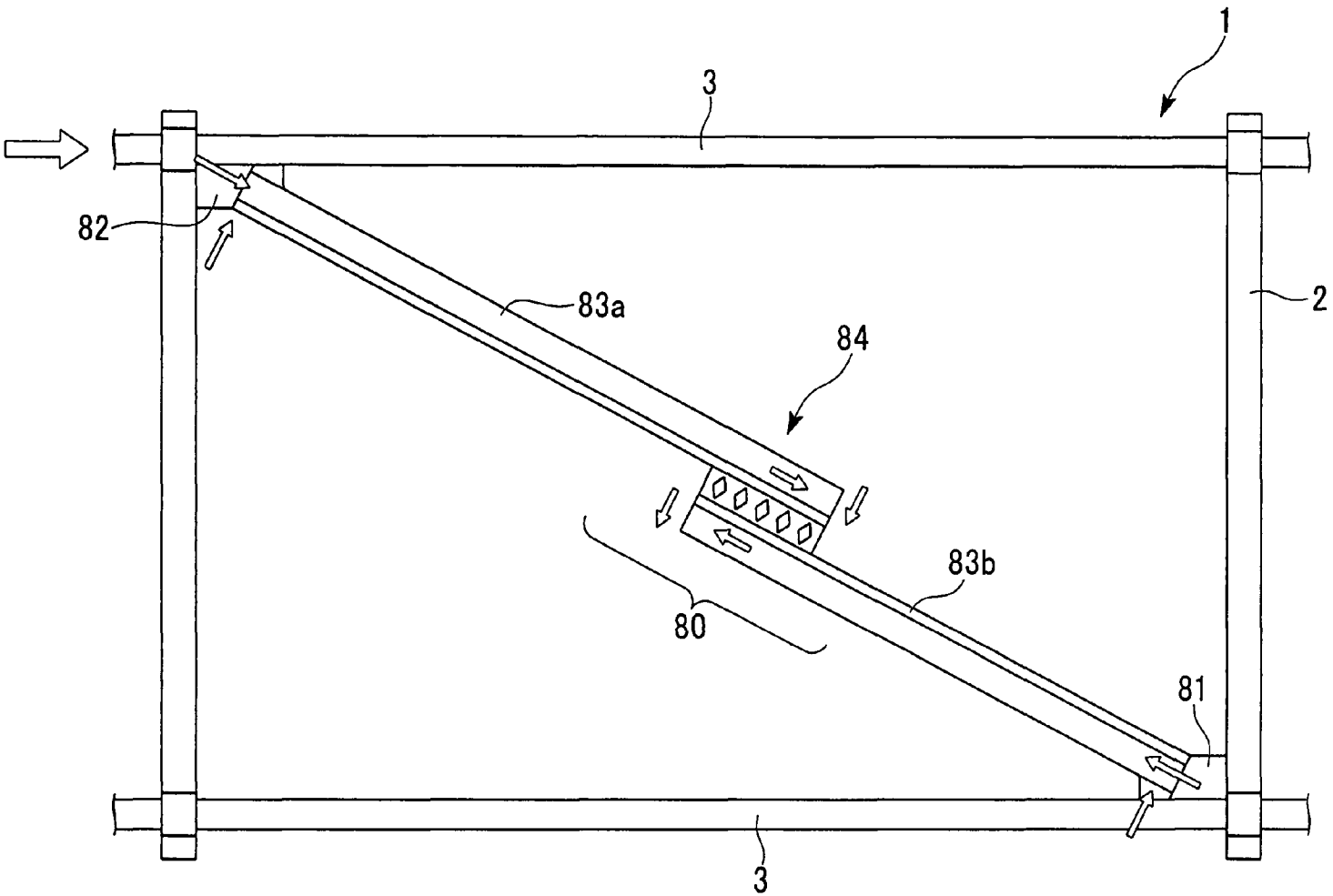
FIG. 9 is a front view illustrating another example of the damping structure of the invention.

FIG. 9 illustrates another vibration damper 80 disposed in the architectural construction 1. Connection members 81 and 82 are provided at the intersection portions between each steel pipe pillar 2 and each beam 3 in the architectural construction 1.

One end of the vibration damper 80 is attached to the connection member 81, and the other end thereof is attached to the connection member 82. The vibration damper 80 includes two brace main members 83*a* and 83*b* as the subject members and a damping portion 84.

One end of the damping portion 84 is attached to the brace main member 83*a*, and the other end thereof is attached to the brace main member 83*b*. In other words, the brace main member 83*a* is attached to the brace main member 83*b* through the damping portion 84. The brace main members 83*a* and 83*b* are all T-section steel.

Figure 10B:
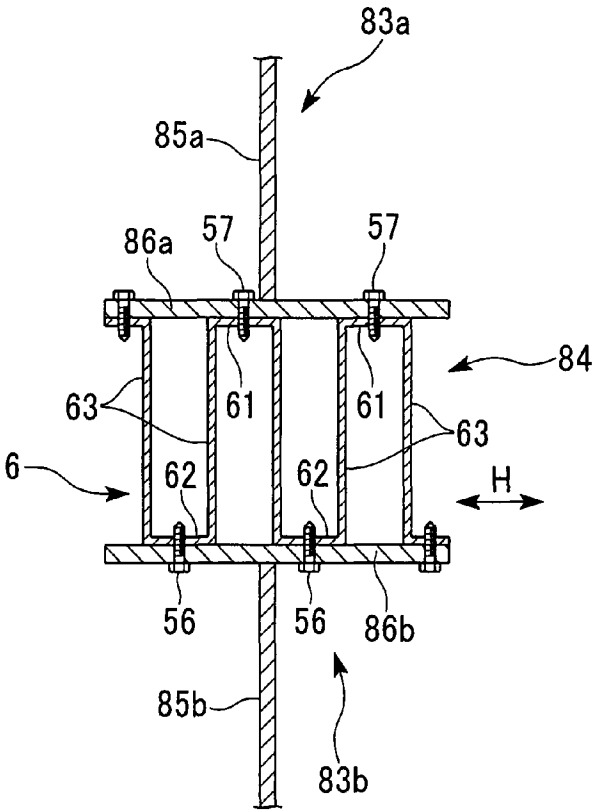
FIG. 10B is a cross-sectional view taken along the line D-D of FIG. 10A.
Figure 10A:
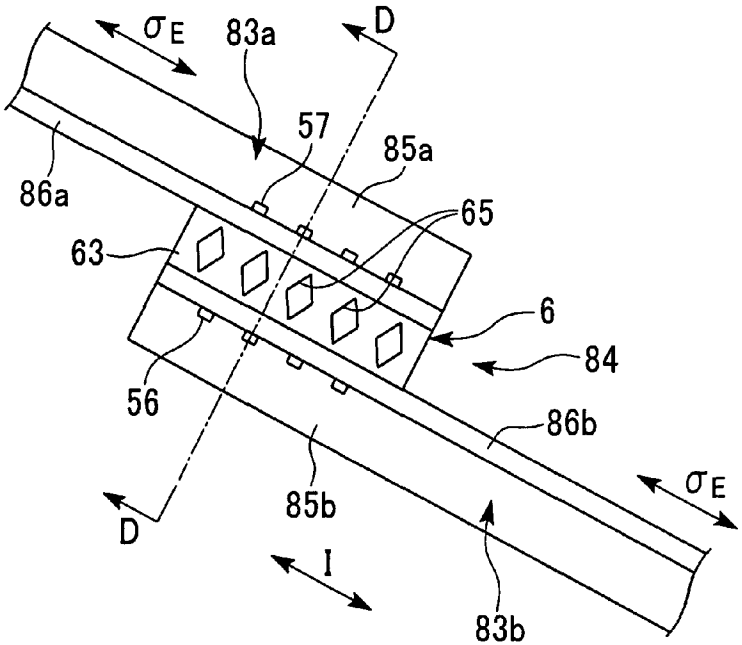
FIG. 10A is an enlarged view specifically illustrating the damping structure.

FIGS. 10A and 10B specifically illustrate a portion around the damping portion 84, where FIG. 10A is an enlarged side view thereof and FIG. 10B is a cross-sectional view taken along the line D-D of FIG. 10A. The brace main member 83*a* is T-section steel that includes a web member 85*a* extending in one direction and a flange 86*a* provided along one edge of the web member 85*a*. In the same manner, the brace main member 83*b* is T-section steel that includes a web member 85*b* extending in one direction and a flange 86*b* provided along one edge of the web member 85*b*.

The metal joint 6 includes multiple (in the example shown in the drawings, two) hill portions 61 and multiple (in the example shown in the drawings, two) valley portions 62 which are alternately formed in the longitudinal direction H of one rectangular steel sheet. Further, the web member 63 is continuously formed between the hill portion 61 and the valley portion 62.

Each hill portion 61 of the metal joint 6 is attached to the flange 86*a* by multiple bolt screws 57, and each valley portion 62 is attached to the flange 86*b* by multiple bolt screws 56. In the embodiment, the subject members correspond to the flanges 86*a* and 86*b*.

The slit 65 is formed at one or more positions (in the example shown in the drawings, five positions) of the metal joint 6. The slits 65 are arranged on the web member 63 at the same interval in the axial direction I perpendicular to at least the longitudinal direction H.

Even in the vibration damper 80 with the above-described configuration, when the architectural construction 1 is deformed by a vibration caused by an earthquake, a stress $\sigma_E$ is applied to the brace main members 83*a* and 83*b* as shown in, for example, FIG. 10A. As a result, a stress $\sigma_E$ is applied to the damping portion 84 (particularly, between the flanges 86*a* and 86*b*) in the axial direction I of the member. Then, when relative displacement occurs in the axial direction I of the member between the subject members (the flanges 86*a* and 86*b*), a shear force similar to that of FIG. 4 is applied to each web member 63, so that the bending moment is applied thereto. As a result, in each web member 63, flexural yielding occurs in the region 63*a* between the adjacent slits 65 by the bending moment applied thereto.

Therefore, as described above, since plastic deformation occurs in each web member 63 by the early flexural yielding thereof, it is possible to exhibit the stable deformation energy absorbing properties while a bearing force thereof is suppressed. Accordingly, it is possible to reliably exhibit sufficient damping properties in the architectural construction 1.

Furthermore, the metal joint 6 adopts the folded structure and is formed in a shape in which the web members 63 reciprocate several times between the subject members (the flanges 86*a* and 86*b*). For this reason, it is possible to increase the arrangement density of each web member 63 between the subject members (the flanges 86*a* and 86*b*). As a result, it is possible to improve the energy absorbing efficiency and further improve the damping properties.

Furthermore, the metal joint 6 is not limited to the attachment structures of the above-described vibration dampers 10 and 80, and may be attached to any subject member.

Second Embodiment

Figure 11:
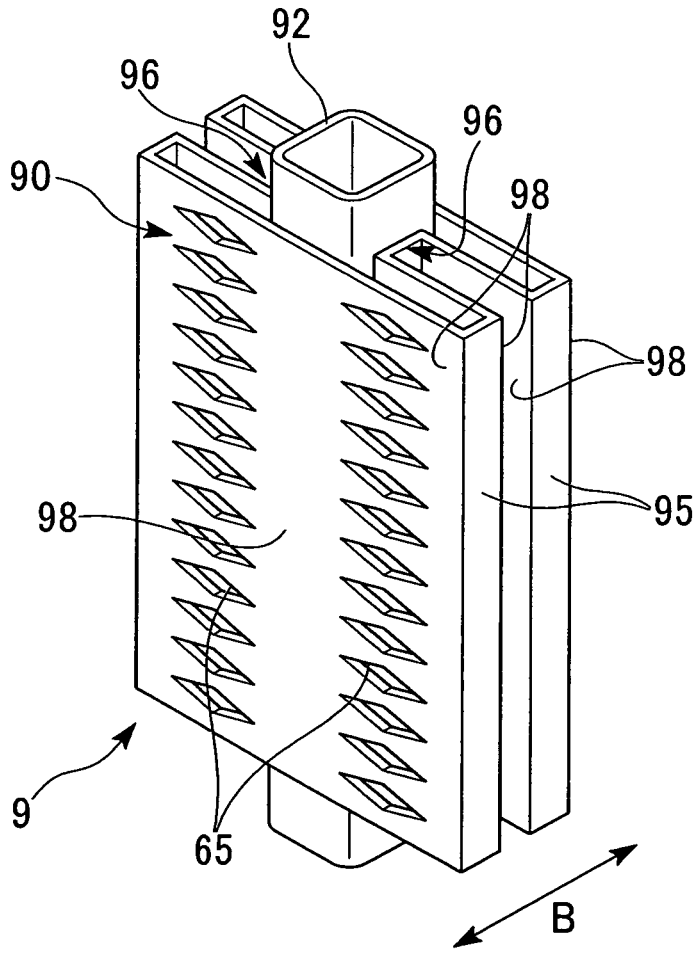
FIG. 11 is a perspective view specifically illustrating a metal joint according to a second embodiment of the invention.
Figure 12:
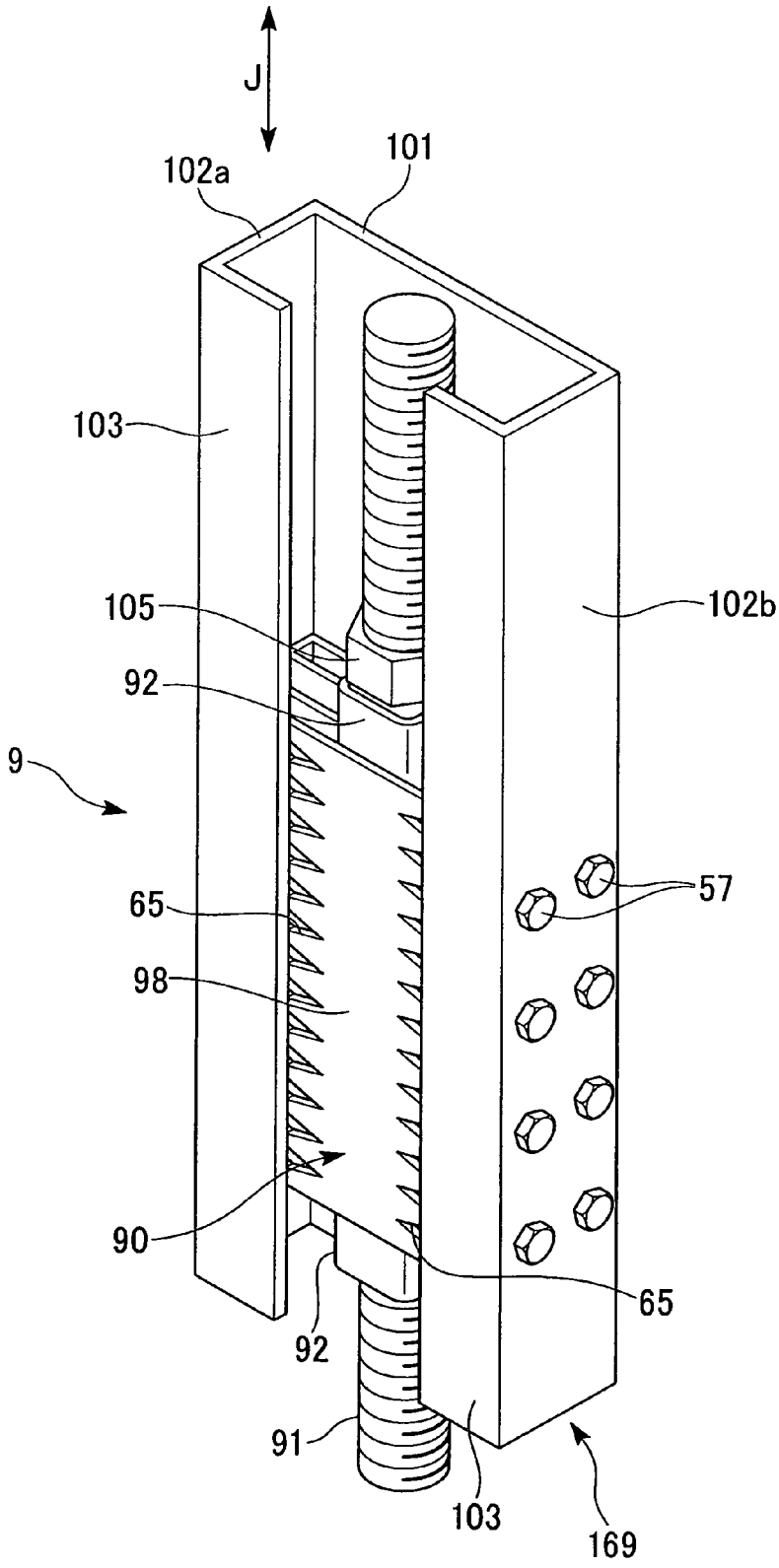
FIG. 12 is a perspective view illustrating a damping structure using the metal joint.

Next, a second embodiment of the metal joint according to the invention will be described. FIG. 11 is a perspective view specifically illustrating a structure of a metal joint 90 of the embodiment. FIG. 12 is a perspective view illustrating a vibration damper 9 in which the metal joint 90 is inserted into a channel steel 169. The vibration damper 9 includes a steel pipe 92 that is connected to an anchor bolt 91. Then, the metal joint 90 is welded to the steel pipe 92.

Figure 13:
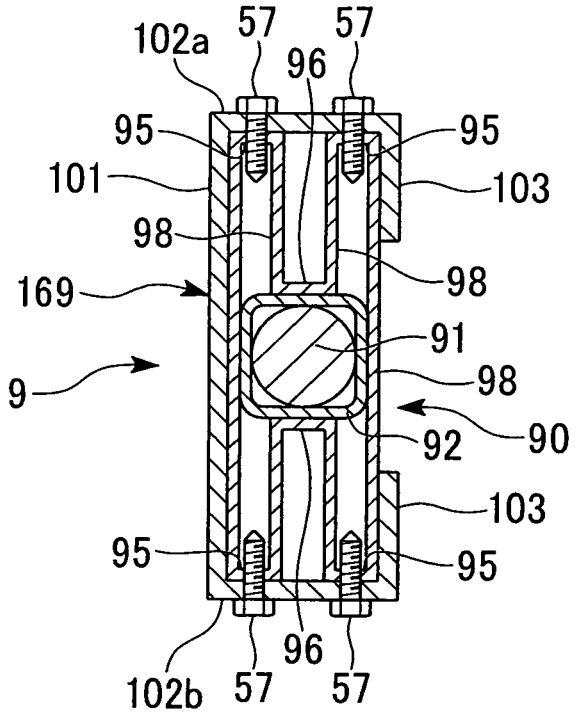
FIG. 13 is a cross-sectional view when the damping structure is seen from the cross-section perpendicular to the longitudinal direction.

In the metal joint 90, multiple slits 65 is formed in each web member 98. The metal joint 90 is formed in a manner such that a steel sheet is alternately folded in the longitudinal direction thereof so that multiple hill portions 95 and multiple valley portions 96 are alternately formed. As shown in FIG. 13, the metal joint has substantially an H-shape when seen from the cross-section perpendicular to the longitudinal direction. When the steel pipe 92 is inserted and welded to the metal joint 90, at least a portion between the steel pipe 92 and each valley portion 96 of the metal joint 90 is welded.

Further, the web member 98 is formed between each hill portion 95 and each valley portion 96. Furthermore, the outer peripheral surface of the metal joint 90 is provided with another web member 98. Each slit 65 is formed at each web member 98. As a result, the yield strength of each web member 98 is suppressed to be lower than those of other positions.

The metal joint 90 having the above-described configuration and the steel pipe 92 welded thereto is inserted into a rib attachment channel steel 169 as shown in FIGS. 12 and 13. The channel steel 169 is substantially C-section steel that includes a web member 101, flanges 102*a* and 102*b* integrally formed with both sides of the web member, and a rib 103 integrally formed with the edges of the flanges 102*a* and 102*b*. Furthermore, each rib 103 may be omitted.

At the time of connecting the metal joint 90 to the channel steel 169, as shown in FIG. 13, the inner surfaces of the flanges 102*a* and 102*b* of the channel steel 169 come into contact with the outer surface of each hill portion 95 of the metal joint 90, and they are connected to each other by a drill screw 57. Subsequently, the attachment is completed in a manner such that nuts 105 are threaded into the upper and lower portions of the anchor bolt 91.

In the vibration damper 9 with the above-described configuration, the above-described subject members correspond to the anchor bolt 91 and the channel steel 169. That is, when the channel steel 169 is applied to, for example, a pillar member of a thin and light steel construction, the anchor bolt 91 as one subject member is displaced in the axial direction J of the member shown in FIG. 12. As a result, a shear stress in the axial direction J of the member is applied to each web member 98 of the metal joint 9 interposed between the subject members (the anchor bolt 91 and the channel steel 169), and the bending moment is applied in this manner. As a result, in each web member 98, flexural yielding occurs in the region 63*a* between the adjacent slits 65 based on the bending moment. As a result, since an increase in bearing force is suppressed by causing plastic deformation to occur in each web member 98 through early flexural yielding thereof, it is possible to exhibit the stable deformation energy absorbing properties. Accordingly, it is possible to exhibit sufficient damping properties in the thin and light steel construction.

Furthermore, the metal joint 90 of the embodiment also adopts the folded structure as in the metal joint 6 of the first embodiment, and is formed in a shape in which the web members 98 reciprocate several times between the subject members. For this reason, it is possible to improve the arrangement density of the web members 63 between the subject members (the anchor bolt 91 and the channel steel 169). As a result, it is possible to improve the energy absorbing efficiency and further improve the damping properties. Furthermore, the metal joint 90 with the above-described configuration may be applied to a thin and light steel construction.

As described above, each of the metal joints according to the first and second embodiment is formed as a metal joint connecting a pair of subject members relatively displaceable in one direction, the metal joint including: multiple first attachment portions attached to one of the subject members; a second attachment portion attached to the other of the subject members; and multiple plate portions connecting each of the first attachment portions and the second attachment portion to each other, wherein the attachment direction of each of the first attachment portions with respect to one subject member and the attachment direction of the second attachment portion with respect to the other subject member are set so that the surfaces of the plate portions follow the direction of the relative displacement. Then, with this configuration, the above-described operation and effect are successfully obtained.

Example 1

Hereinafter, an example of the metal joint according to the invention will be described. The specific configuration of the metal joint according to the invention is determined by various parameters shown in Equation (1) below. In addition, FIG. 14 illustrates a position of each variable used in Equation (1) below.

$$l \cdot \sqrt[3]{\frac{A}{n \cdot m \cdot s \cdot L \cdot t} \frac{E}{E_s}} < d < \sqrt{\frac{3L}{t} \frac{F}{F_s} \frac{A}{n \cdot m \cdot s}} \qquad \text{Equation (1)}$$

Figure 14:
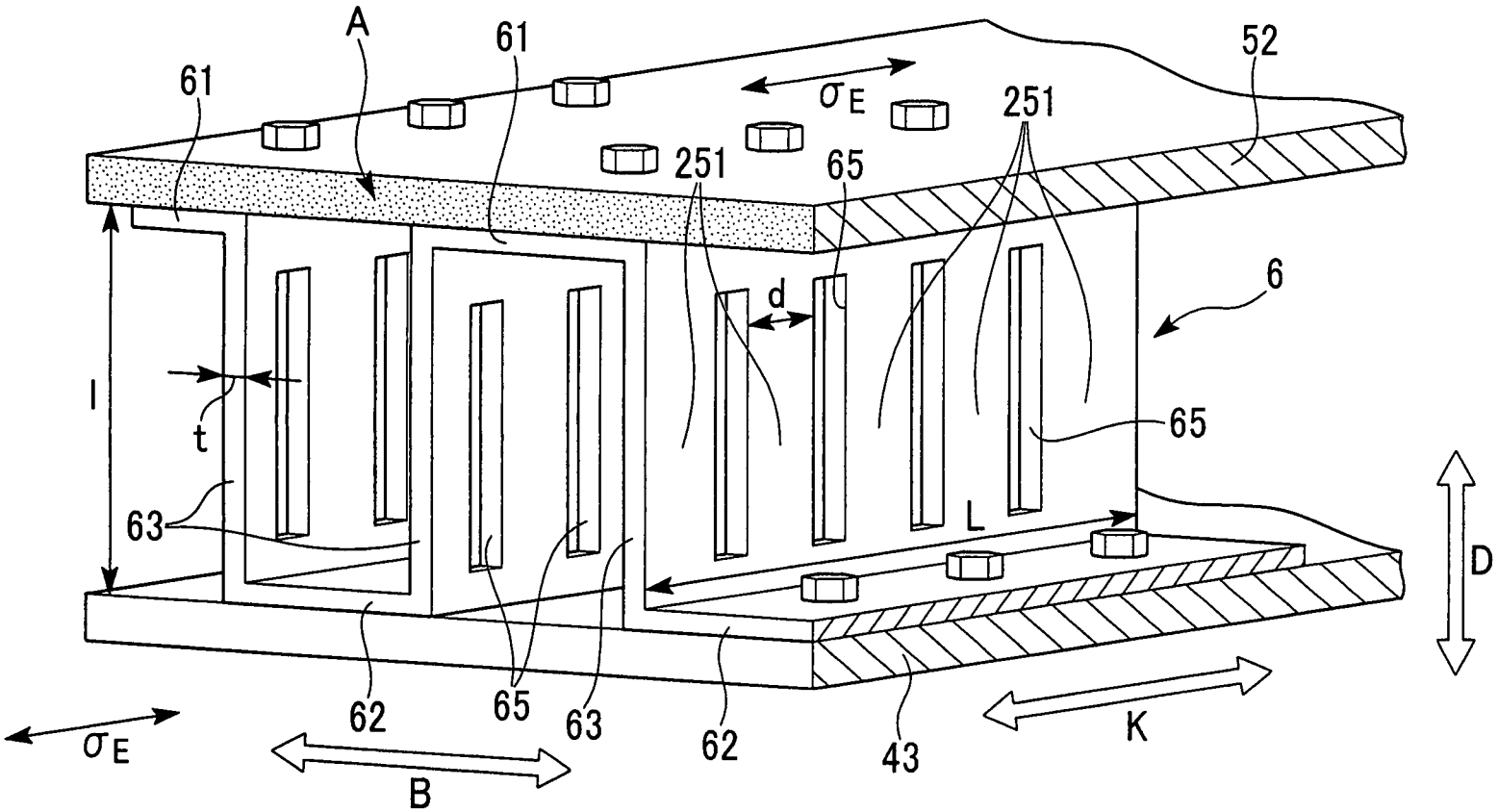
FIG. 14 is an exploded perspective view illustrating one example of the metal joint of the invention.

Here, s indicates the number of folded plates, and in the example of FIG. 14, s=1. Further, n indicates the number of the web members provided with the slits 65 inside the folded plate, and in the example of FIG. 14, n=3. Further, m indicates the number of the stages of the dampers 251, and in the example of FIG. 14, m=5. Further, L indicates the length in the axial direction K of the member of the metal joint. Further, t indicates the plate thickness of the metal joint. Further, A indicates the cross-sectional area of the subject member. Further, l indicates the shear length for each damper 251. Further, F indicates an F value, E indicates the Young's modulus (E with the suffix s indicating the Young's modulus of the damper 251 and E without the suffix s indicating the Young's modulus of a base material), and d indicates the width between the dampers 251.

Furthermore, each damper 251 indicates the region between the slits 65 or the region formed between each slit 65 and the end in the direction K since the region exhibits the same effect as that of the damper. As described above, the number m of stages of the damper 251 is five in FIG. 14. Further, the number n of the web members provided with the slits 65 is three in FIG. 14. Further, the number s of the folded plates is one.

The cross-sectional area A of the subject member is the region depicted by the dot in FIG. 14. The cross-sectional width d of the damper 251 indicates the width in the direction K of the damper 251.

In Equation (1) above, the condition of d/t<10 (out-of-plane buckling prevention) and l/d>3 (flexural and shear deformation) may be added thereto so that the out-of-plane buckling does not occur in the damper 251, that is, flexural and shear deformation occurs in the plate portion forming the damper 251.

Furthermore, Equation (1) is an equation relating to the cross-sectional width of the damper 251 when the slit 65 is formed in a rectangular shape and the slits are arranged at the same interval. Furthermore, when the damper 251 and the subject member are all steel, they have the same Young's modulus since E=Es=205000 N/mm$^2$.

When the subject member and the damper 251 are formed of different materials, for example, the subject member is iron and steel and the damper is aluminum, E and Es are different.

When the size or various shapes including the cross-sectional width d of the damper 251 are determined in order to satisfy Equation (1), the rigidity of the damper 251 may increase more than that of the subject member and the yield bearing force thereof may be lower than that of the subject member. As a result, it is possible to exhibit a high energy absorbing properties due to the high rigidity and the plastic deformation property of the damper formed as the folded plate.

The left side of Equation (1) is the term determined by the rigidity. That is, the total torsional rigidity of the folded plate forming the metal joint is more than the rigidity of the base material. Further, the right side of Equation (1) is the term determined by the bearing force. That is, this measures that the yield bearing force of the folded plate forming the metal joint is more than the yield bearing force of the base material.

When the above-described parameters satisfy the relation of Equation (1), it is possible to form the metal joint of which the rigidity is maintained high and the yield bearing force is low.

Figure 15:
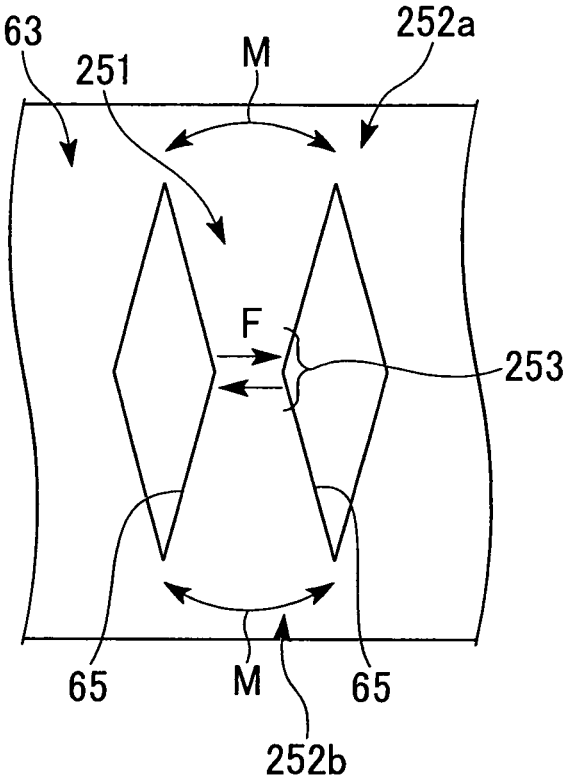
FIG. 15 is a partially enlarged view illustrating the example.

Further, in the invention, for example, as shown in FIG. 15, in the damper 251 allocated between at least the slits 65 in the web member 63, shear yielding may occur in a center 253 in the longitudinal direction and flexural yielding may occur in both ends 252*a* and 252*b*. At this time, the cross-section of the center 253 may be narrowed so as to simultaneously generate shear yielding occurring in the center 253 and flexural yielding occurring in both ends 252*a* and 252*b*.

When the center 253 is narrowed, it is possible to further increase shear stress at the center 253 and further increase flexural stress at both ends 252*a* and 252*b*. Accordingly, the above-described shear yielding and flexural yielding may be made to simultaneously occur.

INDUSTRIAL APPLICABILITY

When the metal joint of the invention is connected between the subject members as a part of the architectural construction, it is possible to improve the energy absorbing properties of absorbing energy of an earthquake or the like and improve the rigidity.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

1: ARCHITECTURAL CONSTRUCTION
2: STEEL PIPE PILLAR
3: BEAM
6: METAL JOINT
10: VIBRATION DAMPER (DAMPING STRUCTURE)
21: STEEL PIPE
22: PILLAR BEAM CONNECTING PORTION
25, 26: CONNECTION MEMBER
31: WEB MEMBER (PLATE PORTION)
32: FLANGE
41: BRACE MAIN MEMBER
42: DAMPING PORTION
43: STEEL PIPE
51: FLANGE
52: WEB MEMBER (PLATE PORTION)
56, 57: BOLT SCREW
61: HILL PORTION (FIRST ATTACHMENT PORTION)
62: VALLEY PORTION (SECOND ATTACHMENT PORTION)
63: WEB MEMBER (PLATE PORTION)
63*a*: REGION BETWEEN SLITS (SLIM PORTION)
65: SLIT (HOLE)
80: VIBRATION DAMPER (DAMPING STRUCTURE)

What is claimed is:

1. A metal joint, configured to connect a first subject member and a second subject member, wherein the first subject member and the second subject member are relatively displaceable in a direction of a relative displacement, the first subject member includes a first attachment plane which is parallel to the direction of the relative displacement, and the second subject member includes a second attachment plane which is opposite to the first attachment plane, the metal joint comprising:

a steel sheet which is arranged between the first attachment plane and the second attachment plane, and is folded to contact to the first attachment plane and the second attachment plane alternately while reciprocating more than one time between the first attachment plane and the second attachment plane along a direction which is orthogonal to the direction of the relative displacement and is parallel to the first attachment plane; wherein the steel sheet includes:

more than one rectangular first attachment portions which are attached to the first attachment plane in a manner that its surface contacts the first attachment plane;

more than one rectangular second attachment portions which are attached to the second attachment plane in a manner that its surface contacts the second attachment plane; and more than one rectangular plate portions which connect the first attachment portion to the adjacent second attachment portion, wherein the plate portion is connected in a right angle to the first attachment portion and the second attachment portion, and wherein an attachment direction of each of the first attachment portions with respect to the first attachment plane and an attachment direction of each of the second attachment portions with respect to the second attachment plane are set so that surfaces of the plate portions follow the direction of the relative displacement.

2. The metal joint according to claim 1, wherein the plate portions have a total yield stress smaller than that of any of the first subject member and the second subject member.

3. The metal joint according to claim 1, wherein each of the plate portions comprises a penetration hole in a direction of the plate thickness.

4. The metal joint according to claim 3, wherein a plurality of the holes is formed in the direction of the relative displacement, and wherein a region is provided between the adjacent holes with the minimal width in the direction of the relative displacement.

5. A damping structure comprising:

a first subject member and a second subject member forming a part of an architectural construction, wherein the first subject member and the second subject member are relatively displaceable in one direction; and a metal joint, according to any one of claims 1 to 4, connecting the first subject member and the second subject member.

6. The damping structure according to claim 5, wherein one of the first subject member and the second subject member is an H-section steel, the other of the first subject member and the second subject member is a steel pipe or a light channel steel, each of the first attachment portions is attached to a web member of the H-section steel, and each of the second attachment portions is attached to the steel pipe or the light channel steel.

7. The damping structure according to claim 6, wherein a lower end of the steel pipe or the light channel steel is fixed to a ground, and the H-section steel is a pillar.

8. An architectural construction comprising the damping structure according to claim 5.

9. The architectural construction according to claim 8, wherein the architectural construction is a lightweight structure.

* * * * *

UNITED STATES PATENT AND TRADEMARK OFFICE

CERTIFICATE OF CORRECTION

PATENT NO. : 8,590,220 B2
APPLICATION NO. : 13/138579
DATED : November 26, 2013
INVENTOR(S) : Fuminobu Ozaki et al.

It is certified that error appears in the above-identified patent and that said Letters Patent is hereby corrected as shown below:

On the Title Page

Item (57) Abstract, change "The invention provides a metal joint connecting a pair of subject members relatively displaceable in one direction, a metal joint connecting a pair of subject members relatively displaceable in one direction, the metal joint comprising: multiple first attachment portions attached to one of the subject members; a second attachment portion attached to another of the subject members; and multiple plate portions connecting between the first attachment portions and the second attachment portion to each other, wherein an attachment direction of each of the first attachment portions with respect to one subject member and an attachment direction of the second attachment portion with respect to the other subject member are set so that a surfaces of the plate portions follow a direction of the relative displacement."

to

-- The invention provides a metal joint connecting a pair of subject members relatively displaceable in one direction, the metal joint comprising: multiple first attachment portions attached to one of the subject members; a second attachment portion attached to another of the subject members; and multiple plate portions connecting between the first attachment portions and the second attachment portion to each other, wherein an attachment direction of each of the first attachment portions with respect to one subject member and an attachment direction of the second attachment portion with respect to the other subject member are set so that a surfaces of the plate portions follow a direction of the relative displacement. --;

In the Specification

Column 8, line 63, change "essential to provided" to -- essential to be provided --.

Signed and Sealed this
Fifth Day of August, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,590,220 B2
APPLICATION NO. : 13/138579
DATED : November 26, 2013
INVENTOR(S) : Ozaki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 49 days.

Signed and Sealed this
Twenty-second Day of September, 2015

Michelle K. Lee

Michelle K. Lee
*Director of the United States Patent and Trademark Office*